US010993038B2

(12) United States Patent
Zhang

(10) Patent No.: US 10,993,038 B2
(45) Date of Patent: Apr. 27, 2021

(54) SPEAKER

(71) Applicant: AAC Acoustic Technologies (Shenzhen) Co., Ltd., Shenzhen (CN)

(72) Inventor: Tong Zhang, Shenzhen (CN)

(73) Assignee: AAC ACOUSTIC TECHNOLOGIES (SHENZHEN) CO., LTD., Shenzhen (CN)

( * ) Notice: Subject to any disclaimer, the term of this patent is extended or adjusted under 35 U.S.C. 154(b) by 0 days.

(21) Appl. No.: 16/699,145

(22) Filed: Nov. 29, 2019

(65) Prior Publication Data

US 2020/0196064 A1 Jun. 18, 2020

(30) Foreign Application Priority Data

Dec. 12, 2018 (CN) ..... 201822090444.5

(51) Int. Cl.

| | |
|---|---|
| ***H04R 1/02*** | (2006.01) |
| ***H04R 9/00*** | (2006.01) |
| ***H04R 15/00*** | (2006.01) |
| ***H04R 7/16*** | (2006.01) |
| ***H04R 7/12*** | (2006.01) |
| ***H04R 1/28*** | (2006.01) |

(52) U.S. Cl.

CPC ..... *H04R 15/00* (2013.01); *H04R 1/023* (2013.01); *H04R 1/2811* (2013.01); *H04R 7/127* (2013.01); *H04R 7/16* (2013.01)

(58) Field of Classification Search

CPC ..... H04R 1/02; H04R 1/025; H04R 1/026; H04R 9/00

USPC ..... 381/386, 396, 398

See application file for complete search history.

(56) References Cited

U.S. PATENT DOCUMENTS

| | | | | |
|---|---|---|---|---|
| 9,035,513 | B2 * | 5/2015 | Funaki | H04R 7/18 381/398 |
| 2006/0088182 | A1 * | 4/2006 | Takayama | H04R 9/043 381/398 |
| 2009/0226018 | A1 * | 9/2009 | Nielsen | H04R 1/22 381/398 |

* cited by examiner

*Primary Examiner* — Suhan Ni

(74) *Attorney, Agent, or Firm* — W&G Law Group LLP

(57) ABSTRACT

The invention discloses a speaker. The speaker includes a housing, a magnetic circuit system and a vibration system. The vibration system has a diaphragm and a voice coil. The housing includes a front cover and a frame. The diaphragm has a dome, a suspension and a fixing portion. The frame includes a first connecting wall and a second connecting wall extending from the first connecting wall. The front cover includes a third connecting wall and a fourth connecting wall. The fixing part includes a first fixing portion sandwiched between the first connecting wall and the third connecting wall and a second fixing part sandwiched between the second connecting wall and the fourth connecting wall. By virtue of the configuration, the speaker is provided with better waterproof performance and higher sensitivity.

4 Claims, 5 Drawing Sheets

SPEAKER

FIELD OF THE PRESENT DISCLOSURE

The present disclosure relates to the field of electroacoustic transducers, more particularly to a speaker used in a mobile electronic device.

DESCRIPTION OF RELATED ART

A related speaker typically comprises a housing, a vibration system and a magnetic circuit system accommodated in the housing.

The magnetic circuit system comprises a magnetic yoke and a magnet carried by the magnetic yoke for forming a magnetic gap therebetween. The vibration system comprises a diaphragm and a voice coil having one end thereof disposed in the magnetic gap and another end thereof fixed to the diaphragm. The diaphragm is fixed to the housing, so that the voice coil is suspended in the magnetic gap. The housing includes a front cover and a frame engaging with the front cover The diaphragm is sandwiched between the front cover and the frame The connections between the front cover and the diaphragm, and between the diaphragm and the frame are performed by glue. Engaging surfaces between the diaphragm and the front cover, and between the diaphragm and the frame are defined as Gluing Surfaces. The gluing surface is generally a plane. When the width of the gluing surface is too small, the engaging area is small, which causes the bonding strength for engaging the diaphragm, the front cover, and the frame is reduced. Further, the waterproof performance of the speaker is badly affected. Another aspect, if the width of the glued surface is too wide, the effective radiation area of the speaker vibration system is reduced, and the sensitivity of the speaker is lowered.

Therefore, it is necessary to provide an improved speaker having better waterproof performance and higher sensitivity.

SUMMARY OF THE PRESENT DISCLOSURE

One of the primary objects of the present disclosure is to provide a speaker with improved waterproof performance and higher sensitivity.

Accordingly, the present disclosure provides a speaker, including:

a housing with accommodating space formed by a front cover and a frame engaging with the front cover;

a magnetic circuit system in the accommodating space;

a vibration system in the accommodating space, including a diaphragm assembled with the housing and a voice coil connected with the diaphragm for driving the diaphragm to vibrate for radiating sound;

the diaphragm comprising a dome portion located at a middle position thereof, a suspension surrounding the dome portion and a fixing portion surrounding the suspension;

the frame comprising a first connecting wall close to the voice coil and a second connecting wall extending obliquely from the first connecting wall along a direction away from the accommodating space;

the front cover comprising a third connecting wall engaging with the first connecting wall and a fourth connecting wall engaging with the second connecting wall; wherein the fixing portion comprises a first fixing portion sandwiched between the first connecting wall and the third connecting wall, and a second fixing portion sandwiched between the second connecting wall and the fourth connecting wall.

Further, the second connecting wall extends from the first connecting wall along a direction away from the accommodating space and away from the front cover.

Further, the frame further comprises a fifth connecting wall extending from the second connecting wall along a direction away from the accommodating space, the front cover further comprises a sixth connecting wall engaging with the fifth connecting wall; the fixing portion further comprises a third fixing portion sandwiched between the fifth connecting wall and the sixth connecting wall.

Further, the fifth connecting wall horizontally extends from an edge of the second connecting wall along a direction away from the accommodating space.

Further, the fixing portion further comprises a connecting part for connecting the first fixing portion and the suspension.

BRIEF DESCRIPTION OF THE DRAWINGS

Many aspects of the exemplary embodiment can be better understood with reference to the following drawings. The components in the drawing are not necessarily drawn to scale, the emphasis instead being placed upon clearly illustrating the principles of the present disclosure.

DETAILED DESCRIPTION OF THE EXEMPLARY EMBODIMENT

The present disclosure will hereinafter be described in detail with reference to an exemplary embodiment. To make the technical problems to be solved, technical solutions and beneficial effects of the present disclosure more apparent, the present disclosure is described in further detail together with the figure and the embodiment. It should be understood the specific embodiment described hereby is only to explain the disclosure, not intended to limit the disclosure.

Figure 1:
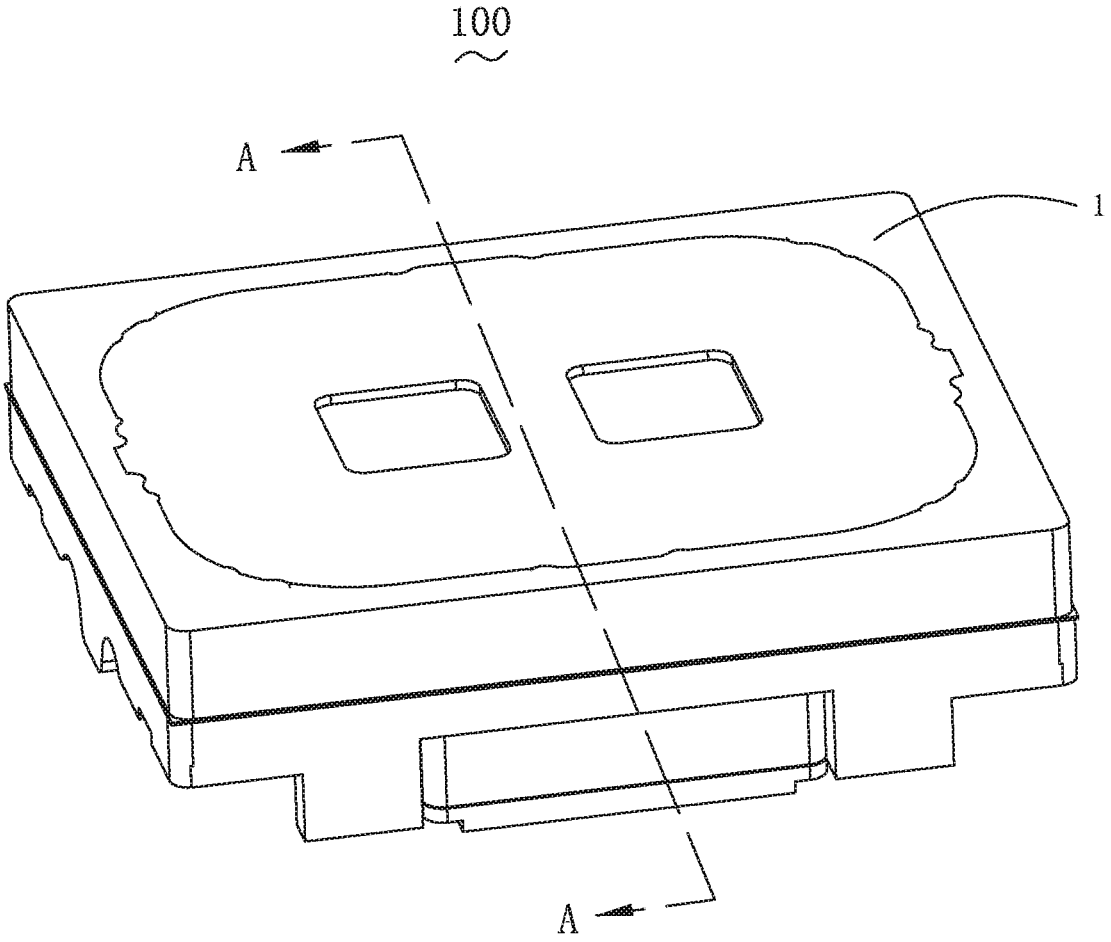
FIG. 1 is n isometric view of a speaker in accordance with an exemplary embodiment of the present disclosure.
Figure 2:
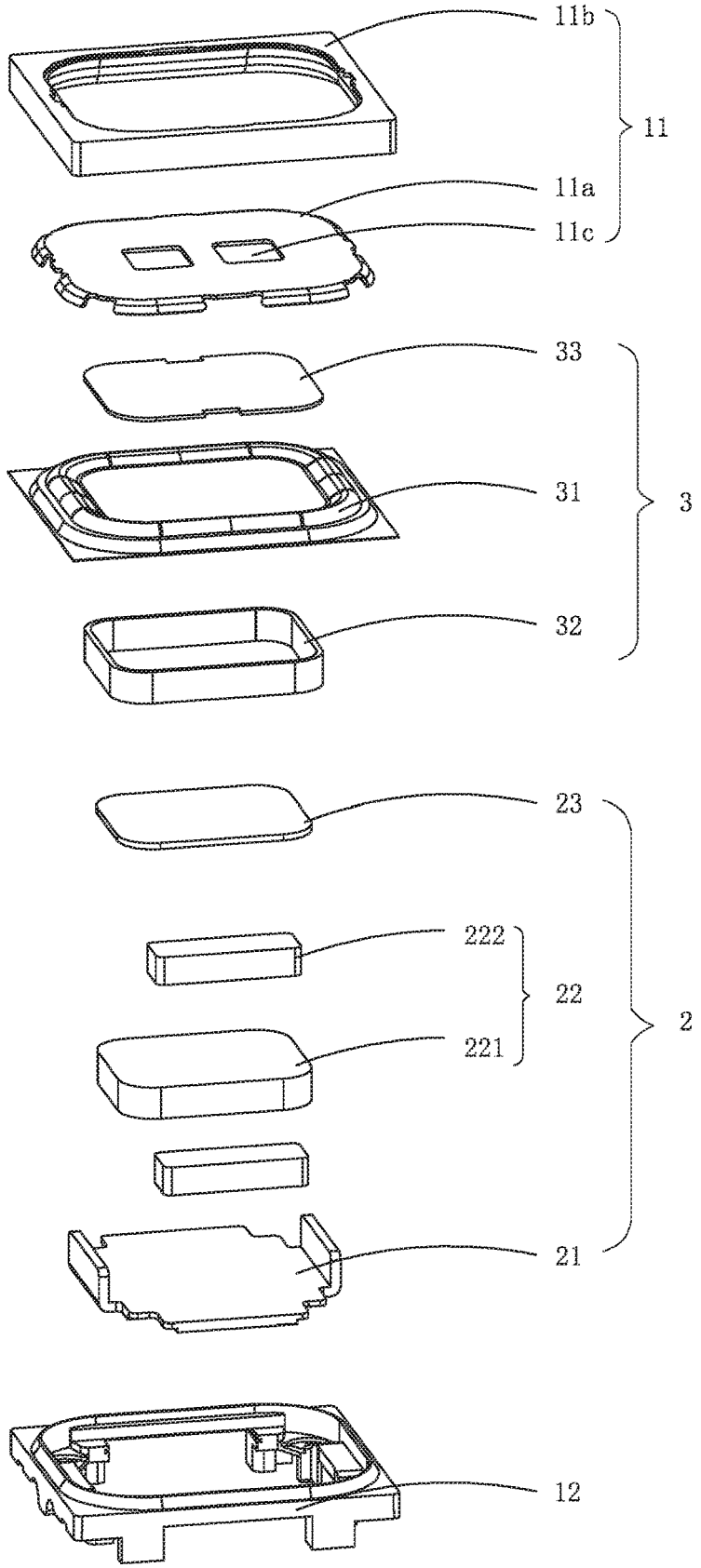
FIG. 2 is an exploded view of the speaker in FIG. 1.

Referring to FIGS. 1-2, a speaker 100 in accordance with an exemplary embodiment of the present disclosure includes a housing 1 having an accommodation space 200, a magnetic circuit system 2 in the accommodation space 200, and a vibration system 3.

The housing 1 includes a front cover 11 and a frame 12 engaging with the front cover 11 for forming a receiving space 200. The frame 12 includes a first connecting wall 121 adjacent to the accommodating space 200 and a second connecting wall 122 extending from the first connecting wall 121 obliquely away from the accommodating space 200. The front cover 11 comprises a third connecting wall 111 engaging with the first connecting wall 121 and a fourth connecting wall 112 engaging with the second connecting wall 122 In this embodiment, the second connecting wall 122 extends obliquely from the first connecting wall 121 away from the accommodating space 200 and away from the front cover 11. Alternatively, the second connecting wall 122 extends in a direction away from the accommodating space 200 but close to the front cover 11 from the first connecting wall 121.

The magnetic circuit system 2 comprises a magnetic yoke 21 assembled with the housing 1, a magnet 22 carried by the magnetic yoke 21 and a pole plate 23 attached to the magnet 22. In particular, the magnetic yoke 21 is fixed to the frame 12. The magnet 22 comprises a main magnet 221 and a plurality of secondary magnets 222 arranged on two sides of the main magnet 221.

Figure 3:
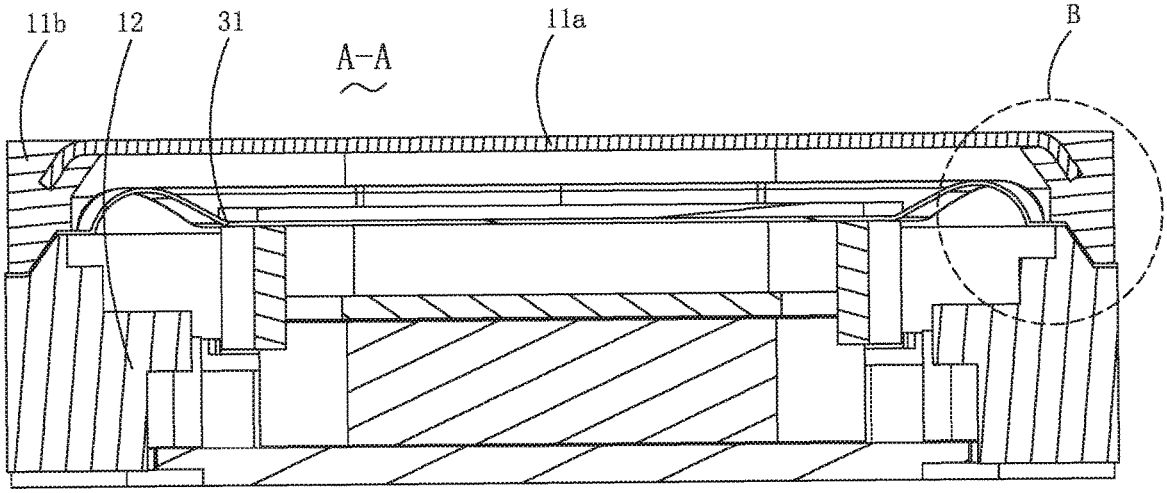
FIG. 3 is a cross-sectional view of the speaker in FIG. 1, taken along line A-A.
Figure 4:
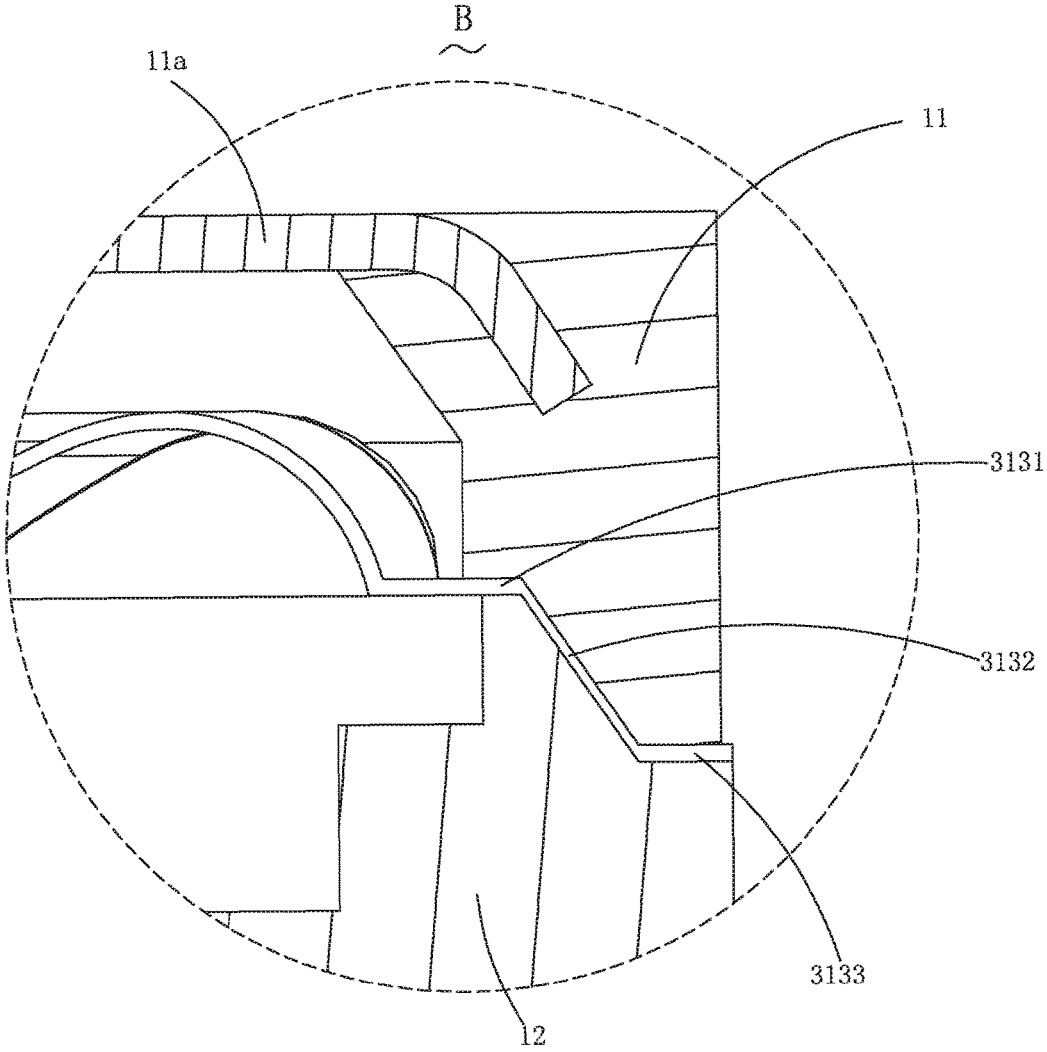
FIG. 4 is an enlarged view of Part B in FIG. 3.
Figure 5:
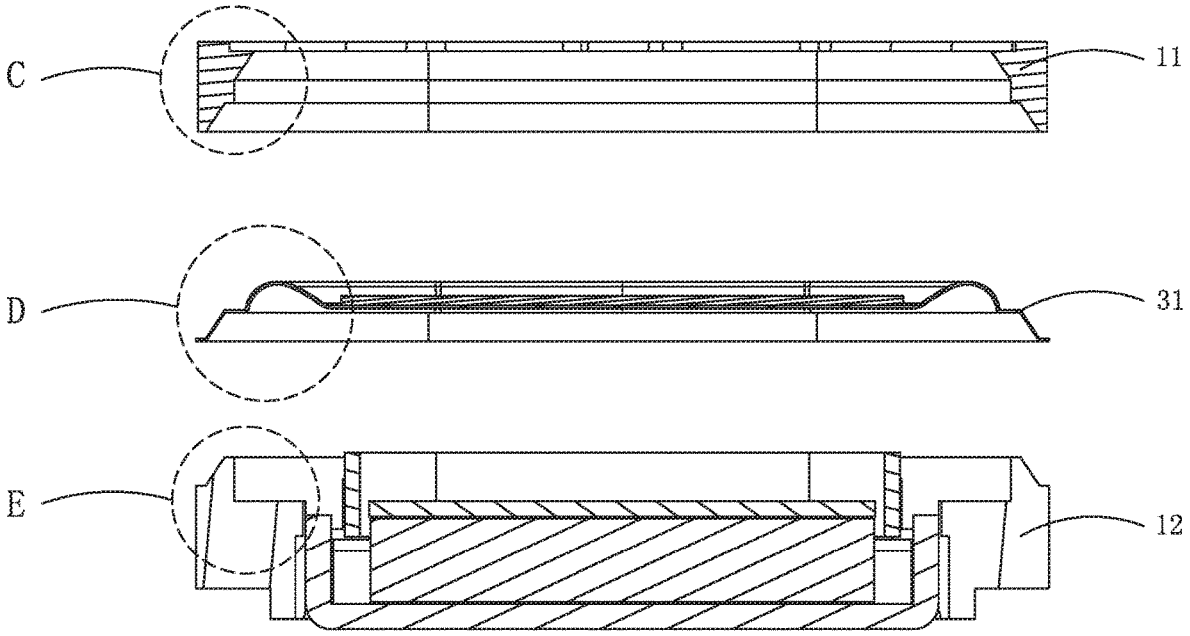
FIG. 5 is a partially exploded view of the speaker in FIG. 3.
Figure 6:
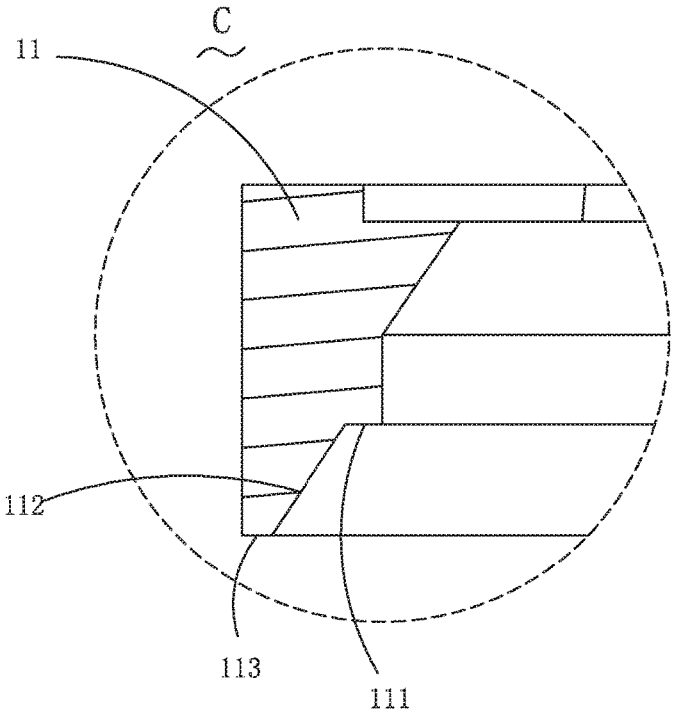
FIG. 6 is an enlarged view of Part C in FIG. 5.
Figure 7:
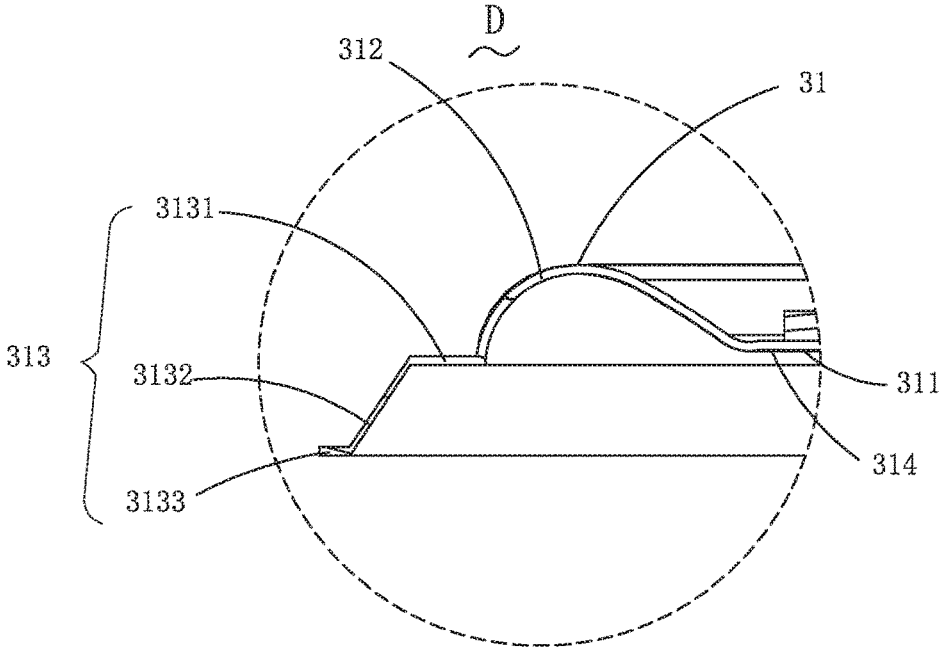
FIG. 7 is an enlarged view of Part D in FIG. 5.
Figure 8:
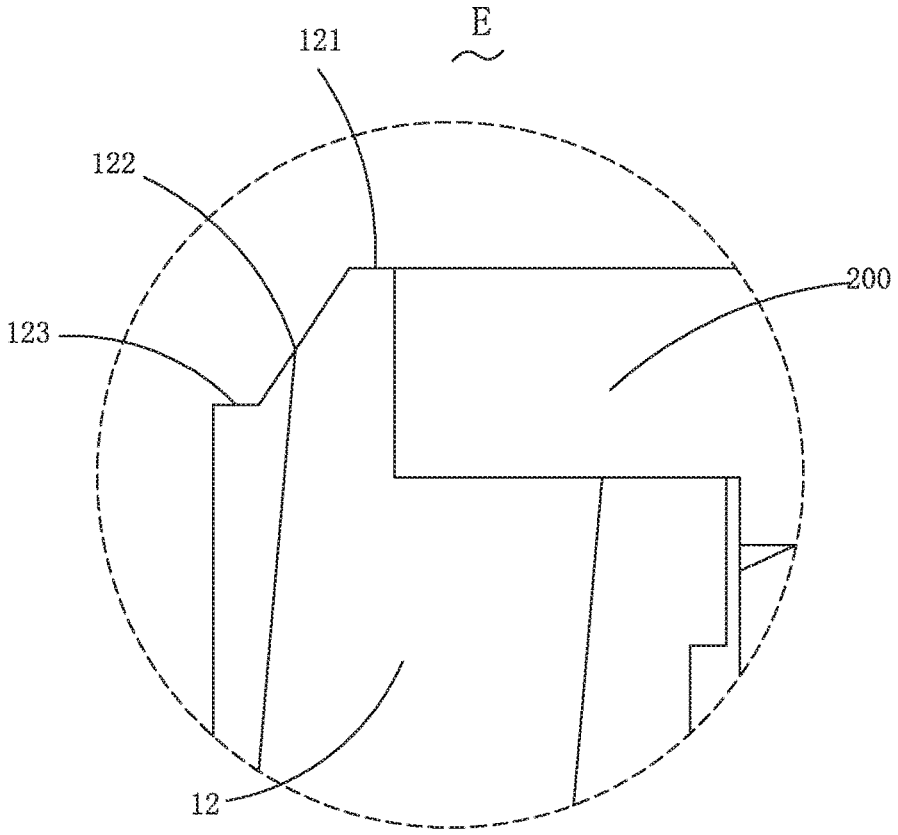
FIG. 8 is an enlarged view of Part E in FIG. 5.

Referring to FIGS. 2-3, the vibration system 3 comprises a diaphragm 31 fixed to the housing 1, a voice coil 32 for driving the diaphragm 31 to vibrate, and a dome 33 attached to the diaphragm 31. The diaphragm 31 comprises a dome portion 311 located at a middle position thereof, a suspension 312 surrounding the dome portion 311, and a fixing portion 313 surrounding the suspension 312. The fixing portion 313 is sandwiched between the front cover 11 and the frame 12. Referring to FIGS. 3-8, the fixing portion 313 includes a first a fixing portion 3131 and a second fixing portion 3132 sandwiched between the second connecting wall 122 and the fourth connecting wall 112. The frame 12 further comprises a fifth connecting wall 123 extending from the second connecting wall 122 along a direction away from the accommodating space 200. The front cover 11 further comprises a sixth connecting wall engaging with the fifth connecting wall 123. The fixing portion 313 further comprises a third fixing portion 3133 sandwiched between the fifth connecting wall 123 and the sixth connecting wall 113. In the embodiment, the fifth connecting wall 123 extends horizontally from an edge of the second connecting wall 122 away from the accommodating space 200. Alternatively, the fifth connecting wall 123 extends obliquely from the edge of the second connecting wall 122 away from the accommodating space 200. By virtue of the structure mentioned above, a contact area between the diaphragm, the frame and the front cover is increased, therefore, the bonding strength is accordingly enhanced. And, the waterproof performance of the speaker is improved. External moisture is prevented from entering the speaker, and the acoustic performance is improved.

In this embodiment, the front cover 11 includes a body portion 11*a* located in an intermediate position and a peripheral portion 11*b* fixedly fitted with the body portion 11*a*. The body portion 11*a* is provided with a sound hole 11*c*.

Specifically, the fixing portion 313 further comprises a connecting portion 314 for connecting the suspension 312 and the first fixing portion 3131, so that the suspension 312 of the diaphragm 31 and the structure fixed with the housing 1 are arranged at intervals, which ensures the diaphragm 31 to vibrate stably, and ensure the diaphragm 31 to have a greater amplitude.

The front cover and the frame of the speaker provided by the present disclosure are provided with inclined surfaces for fixing the diaphragm, which improves the gluing area between the front cover, the frame and the diaphragm. As a result, the bonding strength is increased. Accordingly, the waterproof performance is improved. By virtue of the configuration, width of the contact surface of the front cover, the frame and the diaphragm is narrower, and the effective radiation area of the vibration system is increased. The vibration sensitivity is also improved, and the vibration performance of the speaker is improved.

It is to be understood, however, that even though numerous characteristics and advantages of the present exemplary embodiment have been set forth in the foregoing description, together with details of the structures and functions of the embodiment, the disclosure is illustrative only, and changes may be made in detail, especially in matters of shape, size, and arrangement of parts within the principles of the invention to the full extent indicated by the broad general meaning of the terms where the appended claims are expressed.

What is claimed is:

1. A speaker comprising:

a housing with accommodating space formed by a front cover and a frame engaging with the front cover;

a magnetic circuit system accommodated in the accommodating space;

a vibration system accommodated in the accommodating space, including a diaphragm assembled with the housing and a voice coil connected with the diaphragm for driving the diaphragm to vibrate for radiating sound;

the diaphragm comprising a dome portion located at a middle position thereof, a suspension surrounding the dome portion and a fixing portion surrounding the suspension;

the frame comprising a first connecting wall close to the voice coil and a second connecting wall extending obliquely from the first connecting wall along a direction away from the accommodating space;

the front cover comprising a third connecting wall engaging with the first connecting wall and a fourth connecting wall engaging with the second connecting wall; wherein the fixing portion comprises a first fixing portion sandwiched between the first connecting wall and the third connecting wall, and a second fixing portion sandwiched between the second connecting wall and the fourth connecting wall;

wherein the frame further comprises a fifth connecting wall extending from the second connecting wall along a direction away from the accommodating space, the front cover further comprises a sixth connecting wall engaging with the fifth connecting wall; the fixing portion further comprises a third fixing portion sandwiched between the fifth connecting wall and the sixth connecting wall.

2. The speaker as described in claim 1, wherein the second connecting wall extends obliquely from the first connecting wall along a direction away from the accommodating space and away from the front cover.

3. The speaker as described in claim 1, wherein the fifth connecting wall horizontally extends from an edge of the second connecting wall along a direction away from the accommodating space.

4. The speaker as described in claim 1, wherein the fixing portion further comprises a connecting part for connecting the first fixing portion and the suspension.

* * * * *